US005909947A

United States Patent [19]

DeMarchi

[11] Patent Number: 5,909,947

[45] **Date of Patent: *Jun. 8, 1999**

[54] SPORT FOOTWEAR ASSEMBLY

[75] Inventor: Jean-Louis DeMarchi, Saint-Jorioz, France

[73] Assignee: Salomon S.A., Metz-Tessy, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/784,107

[22] Filed: Jan. 15, 1997

[30] Foreign Application Priority Data

Jan. 22, 1996 [FR] France ..... 96 00833

[51] Int. Cl.[6] ..... A43B 5/04; A43B 3/10; A43B 23/07

[52] U.S. Cl. ..... 36/50.5; 36/115; 36/10; 36/55; 36/99; 36/50.1

[58] Field of Search ..... 36/115, 117.1, 36/50.1, 50.5, 10, 54, 55, 99

[56] References Cited

U.S. PATENT DOCUMENTS

| | | | |
|---|---|---|---|
| 178,449 | 6/1876 | Lindemann | 36/50.1 |
| 470,183 | 3/1892 | Dorr | 36/50.1 |
| 1,224,390 | 5/1917 | Lipinski | 36/50.1 |
| 2,096,677 | 10/1937 | Fassett | 36/8.5 |
| 2,444,428 | 7/1948 | Carrier | 36/50.5 |
| 2,531,763 | 11/1950 | Andre | 36/50.1 |
| 3,008,250 | 11/1961 | Herunter | 36/50.5 |
| 3,837,098 | 9/1974 | Rathmell | 36/50.5 |
| 4,282,659 | 8/1981 | Bourque et al. | 36/121 |
| 4,571,856 | 2/1986 | Lin et al. | 36/50.1 |
| 5,154,011 | 10/1992 | Holzl et al. | 36/117 |
| 5,331,752 | 7/1994 | Johnson et al. | 36/50.1 |

FOREIGN PATENT DOCUMENTS

| | | |
|---|---|---|
| 1191717 | 4/1965 | Germany . |
| WO 89/04126 | 5/1989 | WIPO . |

*Primary Examiner*—M. D. Patterson
*Attorney, Agent, or Firm*—Greenblum & Bernstein P.L.C.

[57] ABSTRACT

Sport footwear assembly, especially an in-line roller skate boot, of the type including two elements, of which one, internal, is a boot, and the other, external, is a boot support coming from the skate. According to the invention, these distinct elements have closure and linkage mechanisms constituted by a single lace which carries out the simultaneous tightening of the two elements, in order to ensure their tightening on the foot.

27 Claims, 2 Drawing Sheets

SPORT FOOTWEAR ASSEMBLY

BACKGROUND OF THE INVENTION

1. Field of the Invention

The present invention relates to a sport footwear assembly, especially a boot for a roller skate or in-line roller skate. This assembly is of the type including two elements one of which, "internal", i.e., a liner or a boot, is in direct contact with the foot and envelope the latter, and the other, external, i.e., a boot shell or a boot support coming from the skate, respectively, is adapted to receive and maintain the internal element. In such an assembly, at least the external element includes means for closing and linking the assembly, which means are constituted by hooks or a lace or cable connecting therebetween, along a predetermined alternating path, a series of return hooks or eyelets arranged on the edges of an internal quarter and of an external quarter of the external element demarcating an opening for introducing the user's foot to constitute a lacing zone. In this manner, during a traction on the strands of the lace, the latter tightens the quarters to bring them closer to one another and maintain them in a tightening position on the foot.

2. Background and Material Information

In known assemblies of this type, whether it is a sport boot provided with a liner, or a boot adapted to be affixed to a chassis, it is always tedious for the user to have to perform a first lacing of the internal element, which is in fact the liner in an in-line roller skate, then the lacing of the external element, which is in fact the shell.

SUMMARY OF THE INVENTION

The object of the present invention is to remedy this disadvantage by proposing a sport footwear assembly, which offers an easy and rapid tightening of the two elements, for an equally efficient tightening.

To this end, the invention relates to a sport footwear assembly, especially a roller or in-line roller skate boot, of the type including two elements of which one, internal, is in direct contact with the foot, and the other, external, is capable of receiving the internal element for maintaining it, at least the external element including closure and linkage means for the assembly, constituted by a lace or cable forming two strands connecting to one another, along a predetermined alternating path, a series of return hooks or eyelets arranged on the edges of an opening for introducing the user's foot to constitute a lacing zone, such that during a traction on the strands of the lace, the latter tightens the edges of the opening to bring them closer to one another and maintain them in a tightening position on the foot, wherein each of the internal and external elements of the footwear assembly is provided with an opening for introducing the foot and a corresponding lacing zone, the tightening action on the respective edges of each of the openings being carried out simultaneously by traction on a single lace or cable.

The present invention is also related to the characteristics which will become apparent along the following description, and which must be considered separately or according to their possible technical combinations.

BRIEF DESCRIPTION OF DRAWINGS

This description, provided by way of non-limiting example, will help to better understand how the invention can be embodied, with reference to the annexed drawings, in which.

DETAILED DESCRIPTION OF THE PREFERRED EMBODIMENTS

Figure 1:
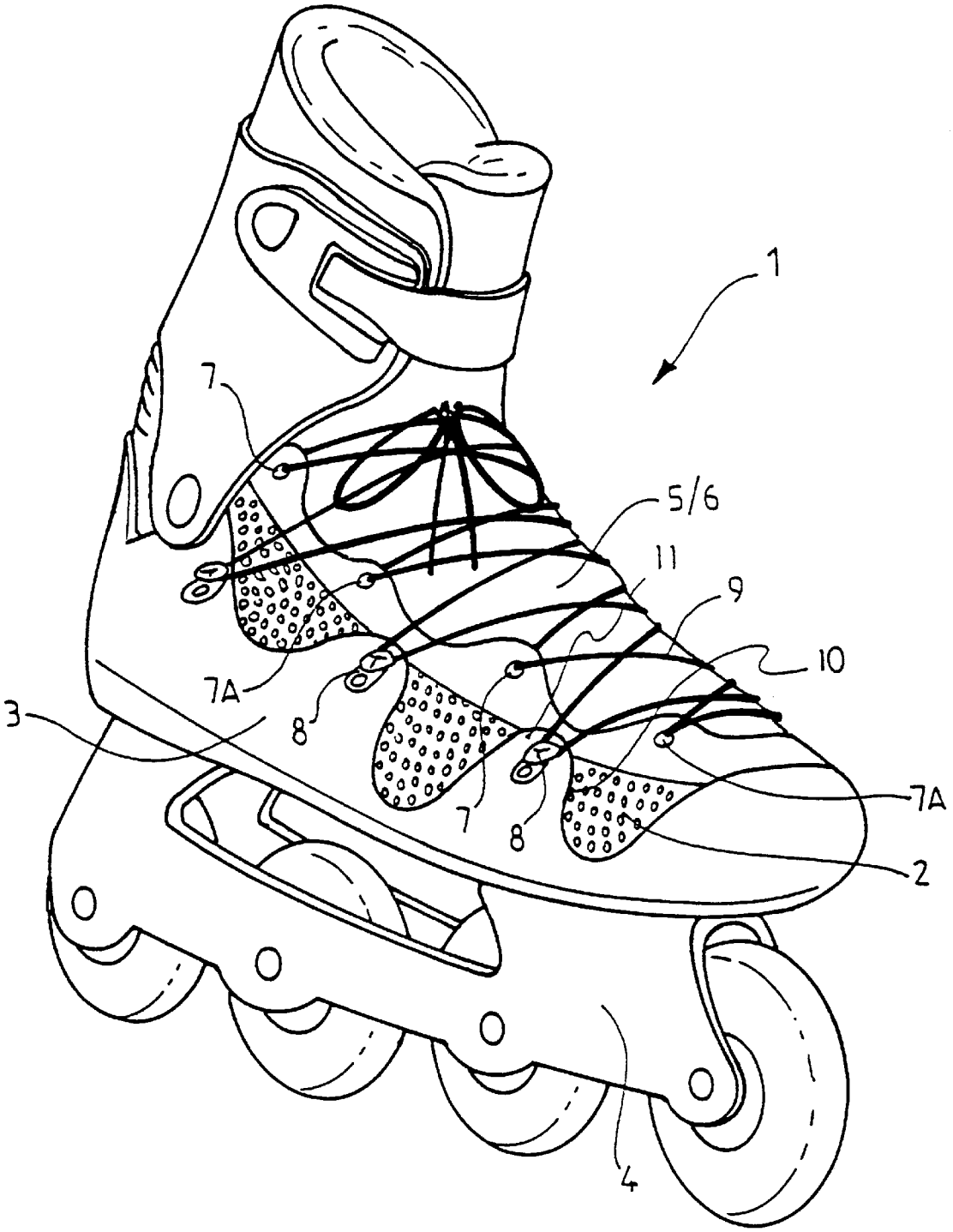
FIG. 1 is a perspective view of an in-line roller skate according to an example of application of the lacing device according to the invention.

The in-line roller skate 1 designated in the figures is only cited as a specific example of an embodiment. It is obvious that it could be any other type of sport boot.

This is a boot assembly including two element, i.e., an internal element 2, which is in fact a liner or a relatively flexible walking boot, and an external element 3, which is in fact a relatively rigid support affixed to the chassis 4 of the skate 1 and capable of receiving the liner or flexible boot 2.

Each of these internal 2 or external 3 elements, i.e., the boot and its support, has an opening 5 and 6, respectively, for introducing the foot.

These openings 5 and 6 are each demarcated by an internal quarter 5A, 6A, respectively, and an external quarter 5B, 6B, respectively.

Pairs of eyelets 7, 7A are arranged on each of the edge-portions of the opening 5 of the internal element 2, while hooks 8 are arranged on each of the edge-portions of the opening of the external element 3. A single cable or lace 9 passes alternatively on the eyelets 7, 7A, and the hooks 8 of the various quarters 5A, 5B, 6A, 6B, through the two strands 9*a*, 9*b*, respectively.

The tightening action on the respective internal quarters 5A, 6A, and external 5B, 6B, demarcating each of the openings 5 and 6, is carried out simultaneously by traction on the single lace or cable 9 connecting the aforementioned hooks 8 or eyelets 7, 7A, to one another, along a predetermined alternating path, in a manner that will be described hereinafter, to constitute means for closure and single connection of the footwear assembly, during a traction on the strands 9*a* and 9*b* which then tightens the quarters 5A, 6A, and 5B, 6B, to bring them closer to one another and maintain them in a tightening position on the foot. As shown in FIG. 1, scallops 10 can be provided between each portion of the external element 3 having a hook, so as to obtain tightening lugs 11 carrying these hooks, and more easily deformable in view of an easier tightening of the internal element 2.

Figure 4:
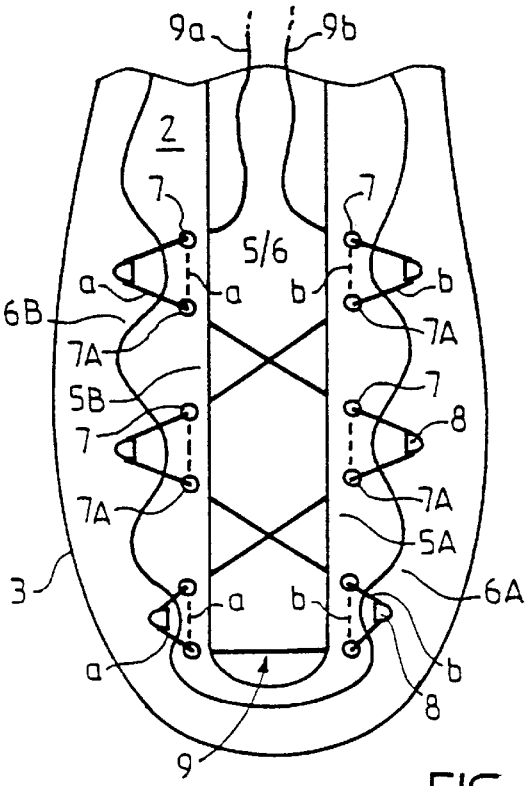
FIG. 4 is an enlarged-scale view of the internal element or boot arranged in the external element or support whose assembly constitutes the skate according to FIG. 1, according to a first type of lacing.
Figure 5:
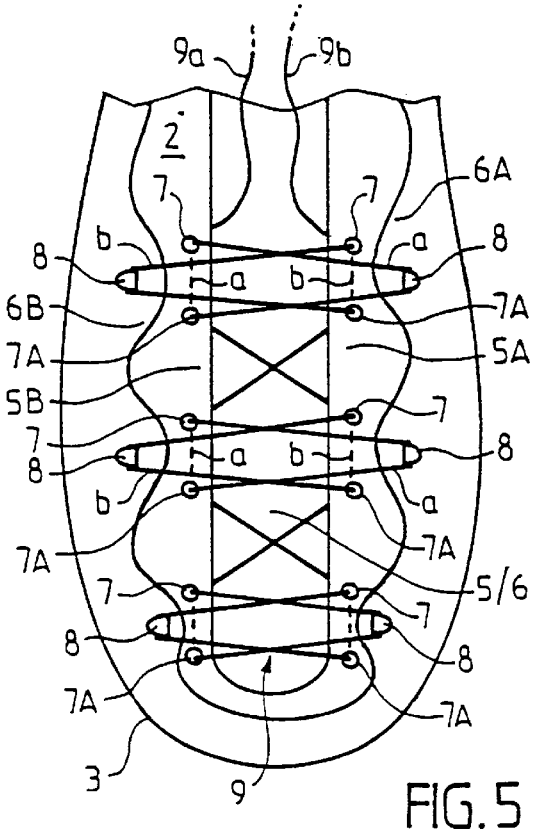
FIG. 5 is an enlarged-scale view of the internal element or boot arranged in the external element or support whose assembly constituted the skate according to FIG. 1, according to a second type of lacing.

As shown more particularly in FIGS. 2–5, the lacing zone of the external element 3 extends beyond, and at a certain distance from the lacing zone of the internal element 2, each hook 8 being arranged between two eyelets 7, 7A, of a same pair and offset with respect thereto. This enables one portion "a" or "b", respectively, of a strand 9*a* or 9*b* connecting two successive eyelets 7, 7A, respectively, of one of the quarters 5A, 5B, of the internal element 2, to be seized and extended by traction toward a hook 8 provided on a quarter 6A, 6B, of the external element 3 and positioned between these two successive eyelets 7, 7A, as shown in FIG. 4, or between two successive eyelets of an opposing quarter 5A, 5B, of the internal element 2, as shown in FIG. 5.

In fact, FIG. 4 shows, according to a first example of tightening, an extension of the portions "a" or "b" of the strands 9*a* or 9*b,* located between two successive eyelets 7, 7A, toward a hook 8 located on the same side as these eyelets, while FIG. 5 shows an extension of the same portions "a" and "b" toward a hook 8 located on the opposite quarter.

There results a different comfort which will be left to the user's choice.

Preferably, the portion "a", "b" of a strand 9*a,* 9*b,* connecting two successive eyelets 7, 7A, passes above the corresponding quarter 5A, 5B of the internal element 2, so as to facilitate the grip thereof.

It will be noted that each internal quarter 5A and external quarter 5B of the internal element 2 includes an identical number of pairs of successive eyelets 7, 7A, symmetrically positioned across from one another, and that each internal quarter 6A and external quarter 6B of the external element 3 includes as many hooks 8 as pairs of eyelets 7, 7A, symmetrically arranged therebetween and along a predetermined outward offset with respect to the eyelets 7, 7A, of the internal element 2.

Figure 2:
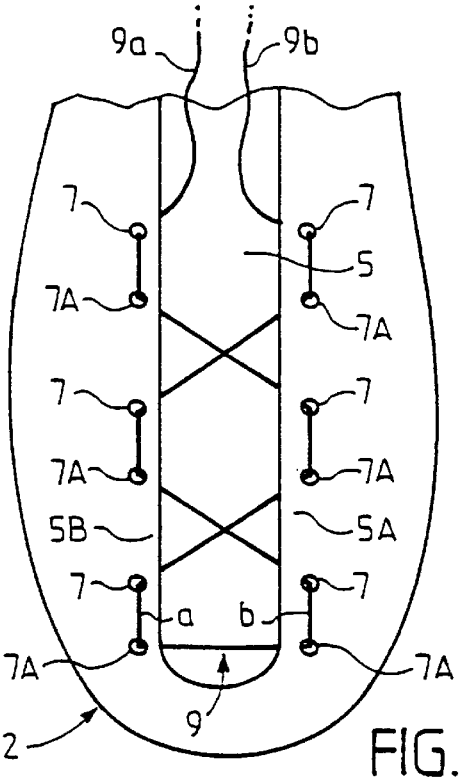
FIG. 2 is an enlarged-scale view of the internal element or boot composing the skate, according to FIG. 1.
Figure 3:
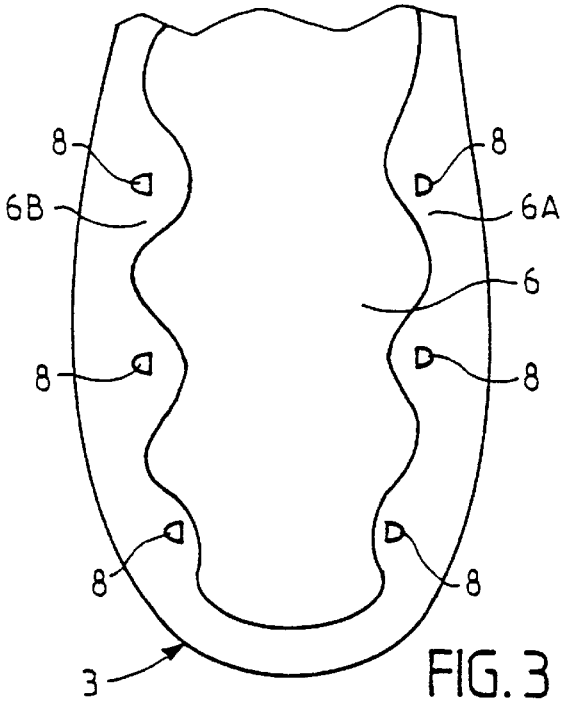
FIG. 3 is an enlarged-scale view of the external element or support coming from the chassis of the skate, according to FIG. 1.

According to the examples shown, and as shown in particular in FIG. 2, but not necessarily, passage of each of the strands 9*a,* 9*b,* from one side to the other of the quarters 5A, 5B, of the internal element 2, is carried out crosswise above the user's foot between each pair of eyelets 7, 7A.

Likewise, according to the example previously cited in FIG. 5, the extension of two portions "a", "b" of strands 9*a,* 9*b,* connecting two pairs of successive eyelets, 7, 7A, of the internal element 2, arranged across from one another, towards two corresponding intermediate hooks 8 of the external element obtained on opposite quarters, makes it possible to obtain a crosswise lacing between the internal element 2 and the external element 3, adding to the crosswise lacing specific to the internal element 2.

According to a first application, the internal element 2 is constituted by a liner capable of being removably inserted in the shell of a boot constituting the external element 3.

According to a second application, the internal element 2 is constituted by a boot capable of being removably positioned in a support coming from a skate and constituting the external element 3, so that it can be easily separated from the skate to constitute a walking boot.

The linkage mode between the chassis 4 of a skate and the internal element 2, of the liner or boot type, according to the invention, is particularly advantageous since it requires only one type of tightening means and a single tightening lace or cable.

Furthermore, the embodiments described hereinabove could of course be reversed, i.e., the pairs of eyelets could be arranged on the external element and the hooks on the internal element.

Other means for passage and return of the laces could also be provided without leaving the scope of the invention.

The instant application is based upon French Priority Application No. 96.00833, filed on Jan. 22, 1996, the disclosure of which is hereby expressly incorporated by reference thereto, and the priority of which is hereby claimed under 35 U.S.C. §119.

What is claimed:

1. A sport footwear assembly comprising:

a sport article; and a footwear article attached to said sport article, said footwear article comprising:

an internal element having a size and shape adapted to receive the entirety of the foot therein and be in direct contact with the foot, said internal element having an opening, defined at least in part by a pair of laterally opposed edge portions at a front portion of the foot, for receiving the foot;

an external element having a size and shape adapted to receive said internal element therein, said external element having an opening, defined at least in part by a pair of opposed edge portions at a front portion of the foot, for receiving the foot;

said external element being affixed to said sport article and said internal element being removably positioned within said external element;

a lacing zone defined by a series of lacing elements on each of said edge portions of said internal element and a series of lacing elements on each of said edge portions of said external element, said lacing zone thereby being provided exclusively at said front portion of the foot; and a single lace forming two strands connected to one another, said lace extending along and connecting said lacing elements in a predetermined alternating path, such that during a traction on said two strands of said lace, said lace tightens said edge portions of said openings to bring said edge portions closer together to maintain said edge portions in a tightening position on the foot, wherein said traction is carried out simultaneously on said two strands of said single lace;

said single lace providing a unique connection of said internal element within said external element at the front part of the foot.

2. A sport footwear assembly according to claim 1, wherein:

said internal element is attached to said external element exclusively with said single lace.

3. A sport footwear assembly according to claim 1, wherein:

said sport article is an in-line roller skate boot.

4. A sport footwear assembly according to claim 1, wherein:

a plurality of said lacing elements comprises a series of eyelets.

5. A sport footwear assembly according to claim 1, wherein:

a plurality of said lacing elements comprises a series of hooks.

6. A sport footwear assembly according to claim 1, wherein:

a plurality of said lacing elements on said internal element comprises a series of eyelets; and a plurality of said lacing elements on said external element comprises a series of hooks.

7. A sport footwear assembly according to claim 1, wherein:

said external element comprises a shell of a boot; and said internal element comprises a liner of said boot.

8. A sport footwear assembly according to claim 1, wherein:

said external element comprises a relatively rigid support affixed to the sport article; and said internal element comprises a separable boot.

9. A sport footwear assembly according to claim 1, wherein:

each of said strands of said single lace extends from one lateral side to another lateral side of said internal element crosswise above the user's foot.

10. A sport footwear assembly comprising:

a sport article; and a footwear article attached to said sport article, said footwear article comprising:

an internal element having a size and shape adapted to receive the foot therein and be in direct contact with the foot, said internal element having an opening, defined at least in part by a pair of laterally opposed edge portions, for receiving the foot;

an external element having a size and shape adapted to receive said internal element therein, said external element having an opening, defined at least in part by a pair of opposed edge portions, for receiving the foot;

said external element being affixed to said sport article and said internal element being removably positioned within said external element;

a lacing zone defined by a series of lacing elements on each of said edge portions of said internal element and a series of lacing elements on each of said edge portions of said external element; and a single lace forming two strands connected to one another, said lace extending along and connecting said lacing elements in a predetermined alternating path, such that during a traction on said strands of said lace, said lace tightens said edge portions of said openings to bring said edge portions closer together to maintain said edge portions in a tightening position on the foot, wherein said traction is carried out simultaneously on said single lace, and wherein said single lace provides a unique connection of said internal element within said external element at a front part of the foot;

said lacing elements of said internal element comprising a series of longitudinally extending series of eyelets positioned along each of said pair of opposed edge portions of said internal element;

said lacing elements of said external element comprising a series of longitudinally extending series of hooks positioned along each of said pair of opposed edge portions of said external element;

said series of hooks on each of said edge portions of said external element being positioned laterally beyond a respective series of eyelets on a respective edge portion of said internal element; and each of a plurality of said hooks being positioned between a respective pair of longitudinally successive ones of said eyelets on a respective edge portion on a respective lateral side of said opening of said internal and external elements, so as to enable a portion of one of said two strands connecting said respective pair of eyelets to be seized and extended by traction toward one of said plurality of said hooks located on a lateral edge portion on a given lateral side of said opening or toward one of said plurality of said hooks located on a lateral edge portion on an a laterally opposed side of said opening.

11. A sport footwear assembly according to claim 10, wherein:

said portion of one of said two strands connecting said respective pair of eyelets extends laterally beyond a corresponding lateral edge portion of said internal element.

12. A sport footwear assembly according to claim 10, wherein:

each respective opening edge portion of said internal element comprises an identical number of pairs of successive eyelets symmetrically positioned laterally across from one another; and each respective opening edge portion of said external element comprises as many hooks as said pairs of eyelets, said hooks being symmetrically arranged between said successive pairs of eyelets and along a predetermined a laterally outward offset with respect to said eyelets of said internal element.

13. A sport footwear assembly comprising:

a sport article; and a footwear article attached to said sport article, said footwear article comprising:

an internal element having a size and shape adapted to receive the foot therein and be in direct contact with the foot, said internal element having an opening, defined at least in part by a pair of laterally opposed edge portions, for receiving the foot;

an external element having a size and shape adapted to receive said internal element therein, said external element having an opening, defined at least in part by a pair of opposed edge portions, for receiving the foot;

said external element being affixed to said sport article and said internal element being removably positioned within said external element;

a lacing zone defined by a series of lacing elements on each of said edge portions of said internal element and a series of lacing elements on each of said edge portions of said external element; and a single lace forming two strands connected to one another, said lace extending along and connecting said lacing elements in a predetermined alternating path, such that during a traction on said strands of said lace, said lace tightens said edge portions of said openings to bring said edge portions closer together to maintain said edge portions in a tightening position on the foot, wherein said traction is carried out simultaneously on said single lace, and wherein said single lace provides a unique connection of said internal element within said external element at a front part of the foot;

said lacing elements of said internal element comprising a series of longitudinally extending series of eyelets positioned along each of said pair of opposed edge portions of said internal element;

said lacing elements of said external element comprising a series of longitudinally extending series of hooks positioned along each of said pair of opposed edge portions of said external element;

two pairs of longitudinally successive eyelets being positioned laterally across from one another and are connected by respective portions of said two strands of said single lace; and each of said respective portions of said two strands extending towards a corresponding hook positioned on a laterally opposite lateral edge portion of said external element to obtain a crosswise lacing between said internal element and said external element.

14. A sport footwear assembly comprising:

a sport article; and a footwear article attached to said sport article, said footwear article comprising:

an internal element having a size and shape adapted to receive the entirety of the foot therein and be in direct contact with the foot, said internal element having an opening, defined at least in part by a pair of laterally opposed edge portions at a front portion of the foot, for receiving the foot;

an external element having a size and shape adapted to receive said internal element therein, said external element having an opening, defined at least in part by a pair of opposed edge portions at a front portion of the foot, for receiving the foot;

said external element being affixed to said sport article and said internal element being removably positioned within said external element;

a lacing zone defined by a series of lacing elements on each of said edge portions of said internal element and a series of lacing elements on each of said edge portions of said external element, said lacing zone thereby being provided exclusively at said front portion of the foot; and means for tightening said internal element to the foot and for attaching said internal element to said external element;

said means comprising a single lace forming two strands connected to one another, said lace extending along and connecting said lacing elements in a predetermined alternating path, such that during a traction on said strands of said lace, said lace tightens said edge portions of said openings to bring said edge portions closer together to maintain said edge portions in a tightening position on the foot, and wherein said traction is carried out simultaneously on said two strands of said single lace;

said single lace providing a unique connection of said internal element within said external element at the front part of the foot.

15. A sport footwear assembly according to claim 14, wherein:

said internal element is attached to said external element exclusively with said single lace.

16. A sport footwear assembly according to claim 14, wherein:

said sport article is an in-line roller skate boot.

17. A sport footwear assembly according to claim 14, wherein:

a plurality of said lacing elements comprises a series of eyelets.

18. A sport footwear assembly according to claim 14, wherein:

a plurality of said lacing elements comprises a series of hooks.

19. A sport footwear assembly according to claim 14, wherein:

a plurality of said lacing elements on said internal element comprises a series of eyelets; and a plurality of said lacing elements on said external element comprises a series of hooks.

20. A sport footwear assembly according to claim 14, wherein:

said external element comprises a shell of a boot; and said internal element comprises a liner of said boot.

21. A sport footwear assembly according to claim 14, wherein:

said external element comprises a relatively rigid support affixed to the sport article; and said internal element comprises a separable boot.

22. A sport footwear assembly according to claim 14, wherein:

said lacing elements of said internal element comprise a series of longitudinally extending series of eyelets positioned along each of said pair of opposed edge portions of said internal element;

said lacing elements of said external element comprise a series of longitudinally extending series of hooks positioned along each of said pair of opposed edge portions of said external element;

said series of hooks on each of said edge portions of said external element being positioned laterally beyond a respective series of eyelets on a respective edge portion of said internal element; and each of a plurality of said hooks is positioned between a respective pair of longitudinally successive ones of said eyelets on a respective edge portion on a respective lateral side of said opening of said internal and external elements, so as to enable a portion of one of said two strands connecting said respective pair of eyelets to be seized and extended by traction toward one of said plurality of said hooks located on a lateral edge portion on a given lateral side of said opening or toward one of said plurality of said hook located on a lateral edge portion on an a laterally opposed side of said opening.

23. A sport footwear assembly according to claim 22, wherein:

said portion of one of said two strands connecting said respective pair of eyelets extends laterally beyond a corresponding lateral edge portion of said internal element.

24. A sport footwear assembly according to claim 22, wherein:

each respective opening edge portion of said internal element comprises an identical number of pairs of successive eyelets symmetrically positioned laterally across from one another; and each respective opening edge portion of said external element comprises as many hooks as said pairs of eyelets, said hooks being symmetrically arranged between said successive pairs of eyelets and along a predetermined a laterally outward offset with respect to said eyelets of said internal element.

25. A sport footwear assembly according to claim 14, wherein:

each of said strands of said single lace extends from one lateral side to another lateral side of said internal element crosswise above the user's foot.

26. A sport footwear assembly according to claim 14, wherein:

said lacing elements of said internal element comprise a series of longitudinally extending series of eyelets positioned along each of said pair of opposed edge portions of said internal element;

said lacing elements of said external element comprise a series of longitudinally extending series of hooks positioned along each of said pair of opposed edge portions of said external element;

two pairs of longitudinally successive eyelets are positioned laterally across from one another and are connected by respective portions of said two strands of single lace; and each of said respective portions of said two strands extends towards a corresponding hook positioned on a laterally opposite lateral edge portion of said external element to obtain a crosswise lacing between said internal element and said external element.

27. A sport footwear assembly comprising:

a sport article; and a footwear article attached to said sport article, said footwear article comprising:

an internal element having a size and shape adapted to receive the entirety of the foot therein and be in direct contact with the foot, said internal element having an opening, defined at least in part by a pair of laterally opposed edge portions at a front portion of the foot, for receiving the foot;

an external element having a size and shape adapted to receive said internal element therein, said external element having an opening, defined at least in part by a pair of opposed edge portions at a front portion of the foot, for receiving the foot;

said external element being affixed to said sport article and said internal element being removably positioned within said external element;

a lacing zone defined by a series of lacing elements on each of said edge portions of said internal element and a series of lacing elements on each of said edge portions of said external element, said lacing zone thereby being provided exclusively at said front portion of the foot; and means for tightening said internal element to the foot and for attaching said internal element to said external element;

said means consisting of a single lace forming two strands connected to one another, said lace extending along and connecting said lacing elements in a predetermined alternating path, such that during a traction on said strands of said lace, said lace tightens said edge portions of said openings to bring said edge portions closer together to maintain said edge portions in a tightening position on the foot, and wherein said traction is carried out simultaneously on said two strands of said single lace;

said single lace providing a unique connection of said internal element within said external element at the front part of the foot.

* * * * *